US011458748B2

(12) United States Patent
Zhu

(10) Patent No.: US 11,458,748 B2
(45) Date of Patent: Oct. 4, 2022

(54) PRINTING APPARATUS

(71) Applicant: BROTHER KOGYO KABUSHIKI KAISHA, Nagoya (JP)

(72) Inventor: Feng Zhu, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 93 days.

(21) Appl. No.: 17/133,549

(22) Filed: Dec. 23, 2020

(65) Prior Publication Data

US 2021/0197591 A1 Jul. 1, 2021

(30) Foreign Application Priority Data

Dec. 27, 2019 (JP) ..... JP2019-238978

(51) Int. Cl.
*B41J 11/70* (2006.01)
*B41J 29/393* (2006.01)
*B41J 3/407* (2006.01)

(52) U.S. Cl.
CPC ..... *B41J 11/703* (2013.01); *B41J 3/4075* (2013.01); *B41J 29/393* (2013.01)

(58) Field of Classification Search
CPC ..... B41J 11/703; B41J 11/70; B41J 3/4075; B41J 2/35; B41J 2/355; B41J 2/3551; B41J 2/3553; B41J 2/3555; B41J 2/3556; B41J 2/3558
See application file for complete search history.

(56) References Cited

U.S. PATENT DOCUMENTS

2002/0090243 A1 7/2002 Hosokawa et al.
2003/0118390 A1* 6/2003 Yamada ..... B41J 11/04 400/703
2017/0028747 A1* 2/2017 Kanda ..... B41J 3/4075

FOREIGN PATENT DOCUMENTS

JP H7-228016 A 8/1995
JP 2002-193538 A 7/2002
JP 2012218308 * 11/2012 ..... B41J 11/70

* cited by examiner

*Primary Examiner* — Kristal Feggins
(74) *Attorney, Agent, or Firm* — Kenealy Vaidya LLP

(57) ABSTRACT

A printing apparatus forming a printed matter by a printing medium on which a print is formed, including: a casing having a discharge port; a transporter; a print device forming the print on the printing medium; a cutter; and a controller configured to: obtain medium information; and when the printing medium is not set as a cutting target, control the transporter and the print device in cooperation to: form a desired print while transporting the printing medium; and further transport the printing medium after completion of the forming of the desired print and, when a first boundary part of the printing medium reaches a facing part facing an edge of the discharge port or when the first boundary part is discharged outside the casing, perform positioning by stopping the transporting of the printing medium.

13 Claims, 11 Drawing Sheets

ILLUSTRATIVE EMBODIMENT

SPECIAL TAPE (a) (b) (c) (d) (e)

PRINTING APPARATUS

CROSS-REFERENCE TO RELATED APPLICATIONS

This application claims priority from Japanese patent application No. 2019-238978 filed on Dec. 27, 2019, the entire subject-matter of which is incorporated herein by reference.

TECHNICAL FIELD

The present disclosure relates to a printing apparatus that forms a print on a printing medium.

BACKGROUND

There has been proposed a printing apparatus that creates a printed matter by forming a print on a printing medium. In this related-art printing apparatus, desired printing is performed by a print unit (printing head) on a tape (printing medium) supplied from a cartridge (tape cartridge) and transported. Thereafter, when the tape is further transported and an upstream side end portion of a printed portion reaches a position facing a cutting unit (tape cutter), the upstream side end portion is cut by the cutting unit. The cut tape is further transported to the downstream side, and is discharged to the outside of the device from a discharge port (tape discharge port) provided in the casing (device case).

Here, there are special types of printing media that are difficult to cut by the cutting unit or that are preferably not cut by the cutting unit. In this related-art printing apparatus, cutting by the cutting unit described above is not performed on the special printing medium that adversely affects durability of the cutting unit.

SUMMARY

According to one illustrative aspect of the disclosure, there may be provided a printing apparatus configured to form a printed matter by a printing medium on which a print is formed, the printing apparatus comprising: a casing having a discharge port; a transporter provided inside the casing and configured to transport the printing medium; a print device that is provided on a transport path inside the casing, the printing medium being transported along the transport path to the discharge port by the transporter and is discharged from the discharge port to an outside of the casing, the print device being configured to form the print on the printing medium; a cutter that is provided inside the casing at a position downstream of the print device along the transport path, the cutter being configured to cut the printing medium in a thickness direction; and a controller provided inside the casing, the controller being configured to perform: obtaining medium information corresponding to a type of the printing medium and indicating whether to set the printing medium as a cutting target by the cutter; and in a case the printing medium is not set as the cutting target by the medium information obtained, controlling the transporter and the print device in cooperation with each other to execute: a print forming process comprising forming a desired print while transporting the printing medium; and a first transport process comprising: further transporting the printing medium after completion of the print forming process; and performing positioning by stopping the transporting of the printing medium, in a case a first boundary part of the printing medium reaches a facing part facing an edge of the discharge port along a wall surface direction of the casing or in a case the first boundary part is discharged to the outside of the casing, the first boundary part being positioned at an end portion of a first medium portion on an upstream side in a transport direction on which the desired print is formed on the printing medium.

According to the present disclosure, it is possible to eliminate the complication when a user cuts a printing medium that is not cut by the cutting unit with a cutting tool.

BRIEF DESCRIPTION OF DRAWINGS

Illustrative embodiments of the disclosure will be described in detail based on the following figures, wherein.

DETAILED DESCRIPTION

When the cutting by the cutting unit is not performed as described above, a user needs to cut the upstream side end portion with an appropriate cutting tool (scissors, cutter, or the like). However, the discharge port of the casing is positioned on the downstream side of the cutting unit, and there is a certain distance between the discharge port and the cutting unit. For that reason, if cutting is simply omitted in the flow of the process described above, the vicinity of the upstream side end portion (facing the cutting unit) of the printed portion on which desired print is formed is positioned closer to the inside of the casing than the discharge port. That is, the user cannot perform cutting on the upstream side end portion by the cutting tool as it is. Accordingly, in order to perform the cutting by the cutting tool, the cartridge needs to be removed from the printing apparatus and the printing medium needs to be manually transported, which is complicated and inconvenient.

Therefore, illustrative aspects of the present disclosure provide a printing apparatus that can eliminate the complication when a user performs cutting on a printing medium that is not cut by a cutting unit with a cutting tool.

Hereinafter, an illustrative embodiment of the present disclosure will be described with reference to the drawings.

<Structure of Print Label Creation System>

First, with reference to FIG. 1, an overall configuration of a print label creation system including a label printer of the present illustrative embodiment will be described.

Figure 1:
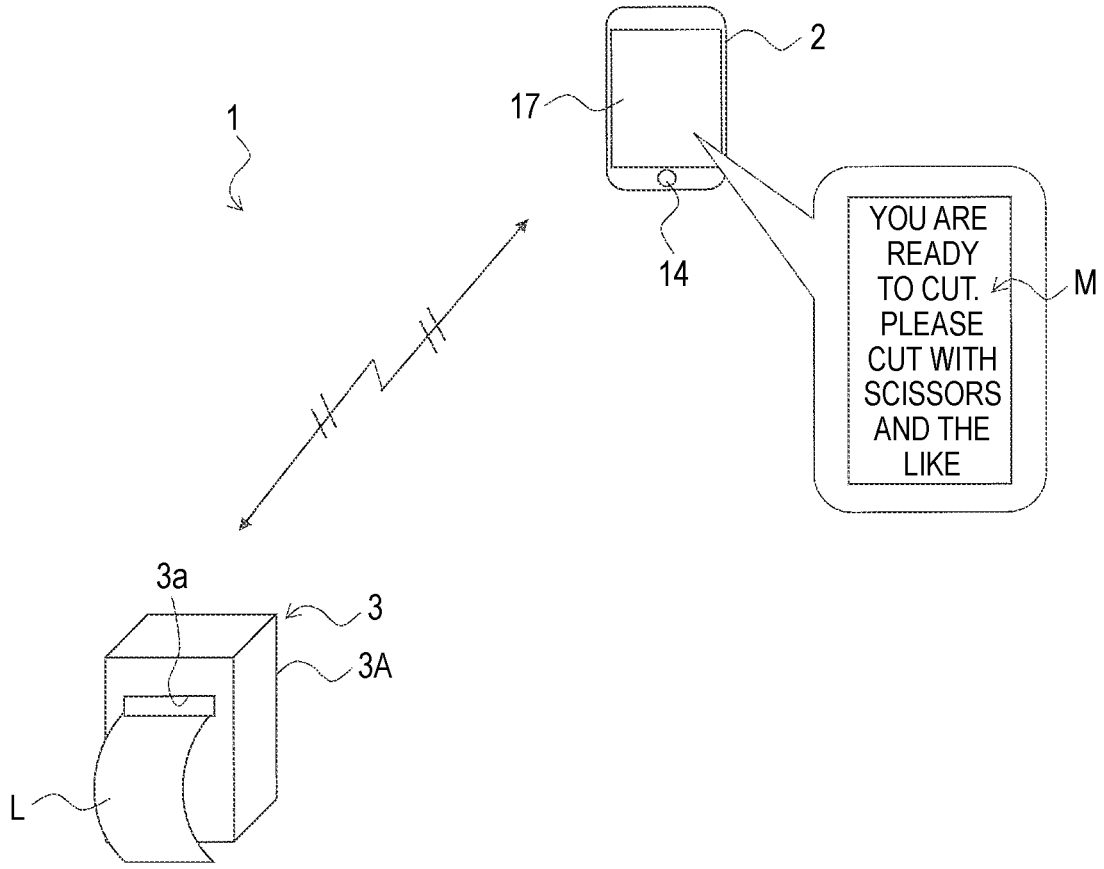
FIG. 1 is a system configuration diagram illustrating an entire print label creation system according to an illustrative embodiment of the present disclosure.

As illustrated in FIG. 1, a print label creation system 1 of the present illustrative embodiment includes a label printer 3 and an operation terminal 2 composed of, for example, a smartphone. The label printer 3 corresponds to an example of a printing apparatus, and the operation terminal 2 corresponds to an example of an external device.

The label printer 3 transmits and receives various information and instruction signals to and from the operation terminal 2, and creates a print label L provided with a print of a desired text, image or the like in response to a printing job transmitted from the operation terminal 2 based on a user's operation. The print label L corresponds to an example of a printed matter. The operation terminal 2 may be a portable information terminal such as a so-called feature phone, various types of computers such as a tablet computer, a notebook computer, and a desktop computer.

<Detailed Structure of Cartridge and Surroundings Thereof>

Inside a casing 3A of the label printer 3, a cartridge 7 for creating the print label L described above is provided so as to be attachable to and detachable from a cartridge holder 6.

Figure 2:
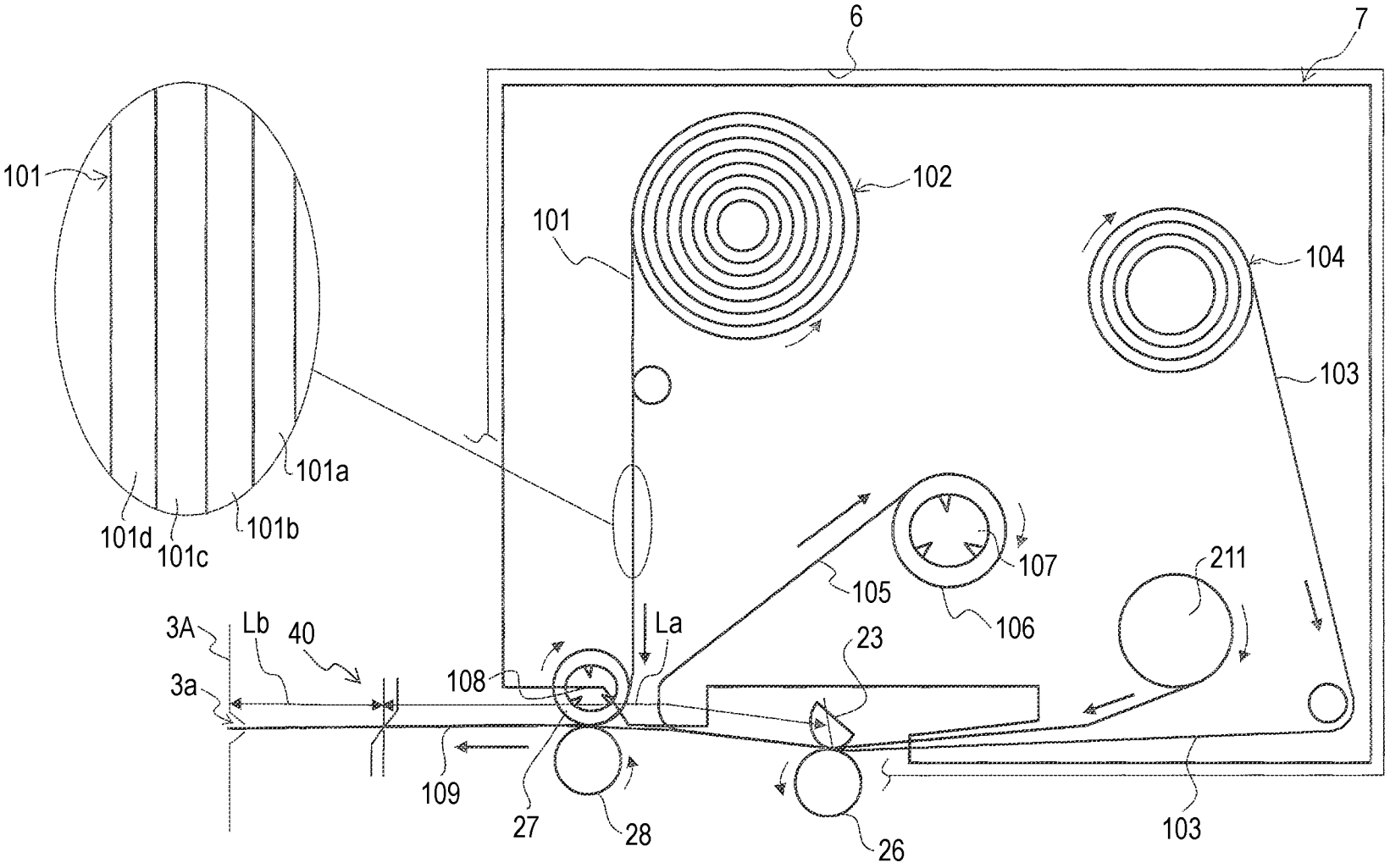
FIG. 2 is an enlarged plan view schematically illustrating an internal structure of a casing including a cartridge holder 6.

As illustrated in FIG. 2, the cartridge 7 is housed in the cartridge holder 6 of the label printer 3, and includes a first roll 102, a second roll 104, a ribbon supply side roll 211, a ribbon winding roller 106, and a tape feed roller 27.

A strip-shaped base tape 101 is wound around the first roll 102, and a transparent printing tape 103 having substantially the same width as the base tape 101 is wound around the second roll 104. An ink ribbon 105 is fed from the ribbon supply side roll 211, and the ink ribbon 105 after printing is wound by the ribbon winding roller 106. However, when a heat sensitive tape is used as the printing medium, the ink ribbon 105 is not necessary.

The tape feed roller 27 is rotatably supported near a tape discharge portion of the cartridge 7. The printing tape 103 and a tape 109 for the printed label in which the base tape 101 is attached to the printing tape 103, correspond to an example of the printing medium.

In this example, the base tape 101 has a four-layer structure (see a partially enlarged view in FIG. 2) in which, from the side wound inside (right side in FIG. 2) to the opposite side (left side in FIG. 2), an adhesive layer 101*a* made of an appropriate adhesive material, a colored base film 101*b* made of PET or the like, an adhesive layer 101*c* made of an appropriate adhesive material, and a release paper 101*d* are laminated in this order. The release paper 101*d* is peeled off when the print label L finally completed in the form of a label is attached to an adherend, so that the print label L is adhered to the adherend by the adhesive layer 101*c*.

In the present illustrative embodiment, the print label L can be created by mounting an appropriate type of cartridge 7 desired by the user, among a plurality of types of cartridges 7 prepared in advance, on the cartridge holder 6.

In the cartridge 7 having the configuration described above, a driving force of a transport motor 119 (see FIG. 3 described later) provided outside the cartridge 7 is transmitted to a ribbon winding roller drive shaft 107 and a tape feed roller drive shaft 108 provided on the cartridge holder 6 via a gear mechanism (not illustrated). With this configuration, the ribbon winding roller 106 and the tape feed roller 27 are rotationally driven by interlocking with each other. On the other hand, the tape feed roller drive shaft 108 is connected to a tape pressure contact roller 28 and a platen roller 26 which are provided on the cartridge holder 6 side by a gear mechanism (not illustrated). As a result, with the drive of the tape feed roller drive shaft 108, the tape feed roller 27, the tape pressure contact roller 28, and the platen roller 26 are rotated, and the base tape 101 is fed out from the first roll 102 and transported, and is supplied to the tape feed roller 27. The tape feed roller drive shaft 108 corresponds to an example of a transport unit.

At this time, by the rotation of the platen roller 26, the printing tape 103 is fed from the second roll 104 and transported, and a print head 23 provided to face the platen roller 26 in the transport path is energized. As a result, a desired print R (see FIGS. 4 to 6, FIGS. 9 and 10, and the like described later) corresponding to print data transmitted from the operation terminal 2 is printed on the back surface of the printing tape 103. The print head 23 corresponds to an example of a print unit. As a result, the tape feed roller 27 and the tape pressure contact roller 28 driven as described above press and adhere the base tape 101 and the printing tape 103 having the print R formed thereon. With this configuration, the tape 109 for the printed label is produced, sent in the direction indicated by the arrow A in FIG. 2, and carried out of the cartridge 7. The ink ribbon 105 after formation of print R on the printing tape 103 is finished is wound around the ribbon winding roller 106 by driving the ribbon winding roller drive shaft 107 described above.

Then, the tape 109 for the printed label, which is attached and produced as described above, is cut by a cutter 40 to produce the print label L, and is discharged from a discharge port 3*a* of the casing 3A to the outside of the casing 3A. At this time, the cutter 40 is arranged downstream side of the print head 23 by a predetermined distance La along the transport path of the printing tape 103. The cutter 40 and the discharge port 3*a* are separated by a predetermined distance Lb along the transport path of the printing tape 103, in other words, the transport path of the tape 109 for the printed label. The cutter 40 corresponds to an example of the cutting unit.

<Control System>

A control system of the label printer 3 and the operation terminal 2 of the present illustrative embodiment will be described with reference to FIG. 3.

<Control System of Operation Terminal 2>

Figure 3:
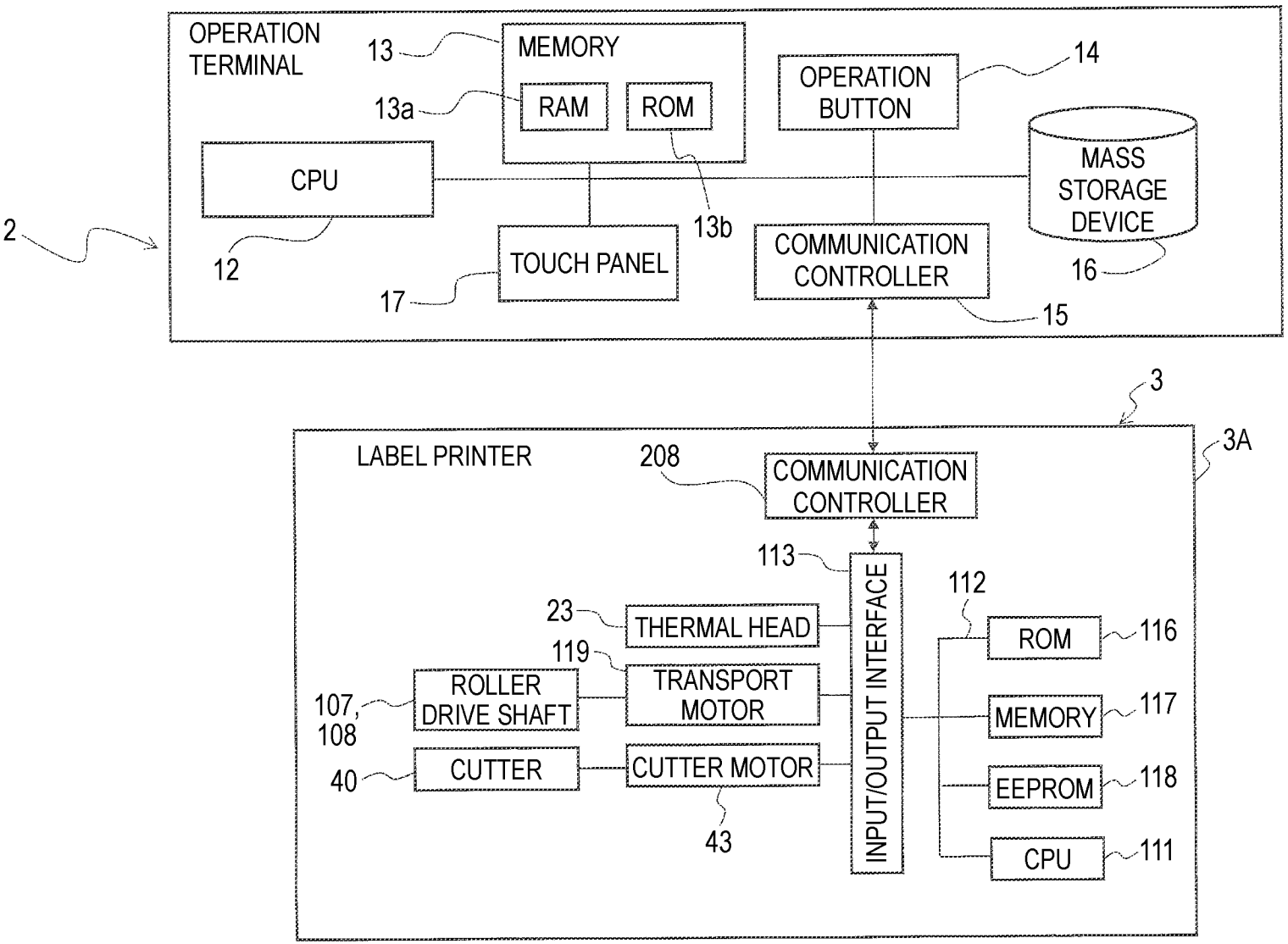
FIG. 3 is a functional block diagram illustrating a control system of a label printer and an operation terminal.

In FIG. 3, the operation terminal 2 includes a CPU 12, a memory 13 including a RAM 13*a* and a ROM 13*b*, an operation button 14, a communication controller 15, a mass storage device 16 such as a flash memory, and a touch panel 17.

In the RAM 13*a* of the memory 13, print data corresponding to desired print content intended to be written on the print label L, which is created by the user appropriately operating the touch panel 17, is stored. The desired print content will be referred to as "label print" hereinafter as appropriate.

The CPU 12 controls the entire operation terminal 2 by executing various programs stored in the ROM 13*b* of the memory 13 and the mass storage device 16 while using a temporary storage function of the RAM 13*a* of the memory 13.

The communication controller 15 controls communication (described later) with the label printer 3. This communication may be wireless communication or wired communication through a cable or the like.

In the ROM 13*b* of the memory 13, a predetermined control program is stored. The control program may be stored in the mass storage device 16. The mass storage device 16 is not limited to a main body memory, and may be an appropriate external memory such as an SD memory card.

<Control System of Label Printer 3>

In FIG. 3, the label printer 3 is provided with a CPU 111 for controlling each device, an input/output interface 113, a ROM 116, a non-volatile EEPROM 118, and a memory 117 each of which is connected to the CPU 111 via a data bus 112. The CPU 111 corresponds to an example of a controller. The EEPROM 118 corresponds to an example of a non-volatile storage unit.

In the ROM 116, various programs necessary for controlling the label printer 3, such as a print control program for driving the print head 23 and the transport motor 119 corresponding to print data from the operation terminal 2 are stored. This program includes a printing processing program for executing each procedure of flowcharts illustrated in FIGS. 8 and 11 described later. The CPU 111 performs various operations based on these various programs to control the label printer 3 as a whole.

Each of the print head 23, the transport motor 119 that drives the ribbon winding roller drive shaft 107 and the tape feed roller drive shaft 108, and a cutter motor 43 that drives the cutter 40 is connected to the input/output interface 113 via an appropriate drive circuit (not illustrated). A communication controller 208 is connected to the input/output interface 113, and the communication controller 208 controls communication (described later) with the operation terminal 2. The components of the label printer 3 illustrated in FIG. 3 are arranged in the casing 3A.

<Normal Tape and Special Tape>

In the label printer 3 having the configuration described above, as described above, an appropriate type of cartridge 7 desired by the user among a plurality of types of cartridges 7 prepared in advance can be used by being mounted on the cartridge holder 6. In this case, depending on the type of the tape provided in each of the plurality of types of cartridges 7, that is, the type of the printing tape 103 or the base tape 101, there is a special type of the tape for which it is difficult to cut with the cutter 40 or it is preferable not to cut with the cutter 40. Hereinafter, such a special type of tape may be referred to as a "special tape", and a type of tape other than the special tape may be referred to as a "normal tape".

In the label printer 3 according to the present illustrative embodiment, as described above, for the normal tape, the print label L is separated from the label tape 109 on the upstream side of the print label L along the tape transport direction by cutting the upstream side end portion of the print label L created by the tape 109 for the printed label with the cutter 40. On the other hand, for the special tape, the special tape is discharged from the discharge port 3*a* without being cut by the cutter 40 as described above, that is, in a state of being connected to the label tape 109 on the upstream side of the print label L, and the user cuts the special tape with an appropriate cutting tool such as scissors. Hereinafter, each operation mode will be described.

<Print Label Creation Using Normal Tape>

First, with reference to sections (a) to (f) of FIG. 4, the behavior of creating the print label L using the normal tape will be described. Actually, as described above, the base tape 101 is attached to the printing tape 103, on which a print is formed by the print head 23, by the tape feed roller 27 and the tape pressure contact roller 28, and the tape 109 for the printed label is provided on the downstream side thereof. In the sections (a) to (f) of FIG. 4, in order to avoid complication in the drawing, the reference numeral "103 (109)" is attached and the tape is schematically illustrated in a single tape shape. The same applies to FIGS. 5 to 7, FIG. 9, and FIG. 10 described later.

Figure 4:
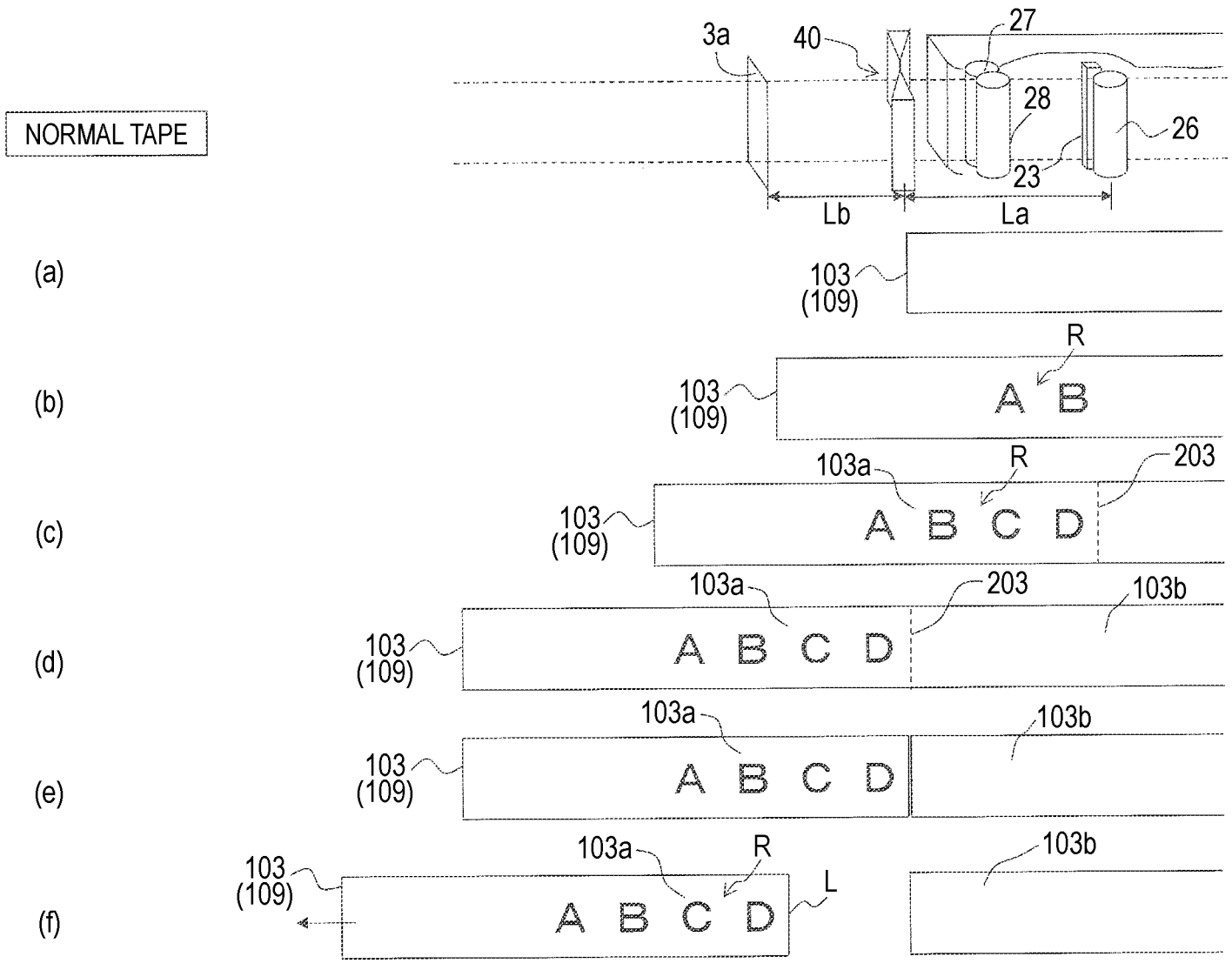
FIG. 4 is an explanatory diagram illustrating a process of creating a printed label when using a normal tape.

The section (a) of FIG. 4 illustrates an initial position state in which the print label L created in advance is cut. From this state, for example, when an appropriate printing start command is input, transportation (hereinafter, simply referred to as "tape transportation") of the printing tape 103, the base tape 101, and the tape 109 for the printed label is started. Along with this, when the print head 23 is energized, formation of the print R of a desired label print, in this example, the print R of the alphabetic characters "ABCD", on a first tape portion 103*a* of the printing tape 103 including a predetermined print area is started. The first tape portion 103*a* corresponds to an example of the first medium portion.

The section (b) of FIG. 4 illustrates a state in which characters "A" and "B" of the "ABCD" are formed as described above. When the tape transportation and the print formation further progress, the print R of all the characters "ABCD" is completed (see the section (c) of FIG. 4). In the section (c) of FIG. 4, an end portion of a portion, which is provided with the print of "ABCD" described above and becomes the print label L, on the upstream side in the transport direction is also conceptually illustrated by a broken line 203. In other words, the part indicated by the broken line 203 is a boundary part between a portion to be the print label L and the tape on the upstream side of the portion, and will be simply referred to as "boundary part" hereinafter.

Figure 5:
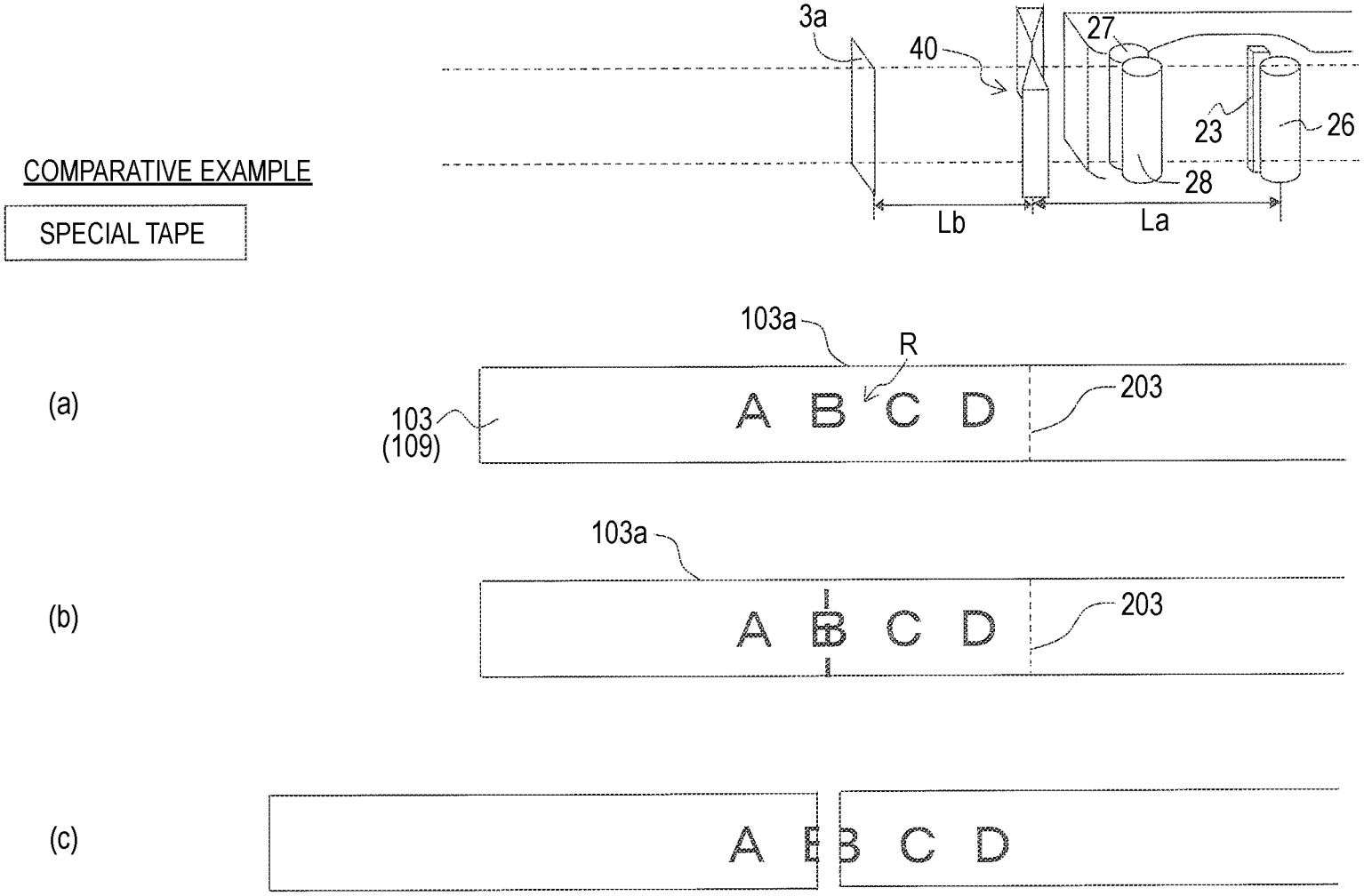
FIG. 5 is an explanatory diagram illustrating a comparative example in which transportation is stopped in the same state as in FIG. 4 and cutting is performed by a cutting tool when a special tape is used.

In the state where formation of the print is completed, energization to the print head 23 is finished, and only the tape is continuously transported. After that, the transportation is continued until the boundary part 203 faces the cutter 40, and when the boundary part faces the cutter 40, the tape transportation is stopped and positioning is performed (see the section (d) of FIG. 4). The transport distance over which the tape is transported from the state illustrated in the section (c) of FIG. 4 to the state illustrated in section (c) of FIG. 5 is equal to the distance La from the print head 23 to the cutter 40 described above.

Thereafter, the cutter 40 is driven to cut the boundary part 203 (see the section (e) of FIG. 4). In this case, the boundary part 203 corresponds to an example of a cut part. As described above, in detail, the entire tape 109 for the printed label including the printing tape 103 and the base tape 101 is cut in the thickness direction. With this configuration, the first tape portion 103*a* on which the print "ABCD" is formed is separated from a second tape portion 103*b* on the upstream side of the boundary part 203 of the printing tape 103. What is separated at this time includes, in addition to the first tape portion 103*a*, the base tape 101 that is attached thereto, but hereinafter, it will be simply referred to as "first tape portion 103*a*" as appropriate. Similarly, in addition to the second tape portion 103*b*, the base tape 101 attached thereto will be simply referred to as "second tape portion 103*b*" hereinafter as appropriate. The second tape portion 103*b* is an example of a second medium portion. The first tape portion 103*a* thus separated is discharged as the print label L from the discharge port 3*a* as illustrated in the section (f) of FIG. 4.

<Print Label Creation with Using Special Tape>

As described above, in the present illustrative embodiment, the special tape is not cut by the cutter 40. Problems that may occur in the creation behavior of the print label L in such a case will be described with reference to a comparative example illustrated in FIG. 5.

In the comparative example illustrated in FIG. 5, after the behavior similar to those of the sections (a), (b) and (c) of FIG. 4 as described above, as illustrated in section (a) of FIG. 5 similar to the section (d) of FIG. 4, the boundary part 203 faces the cutter 40 and the tape transportation is stopped. This boundary part corresponds to an example of a first boundary part. At this time, since it is not possible to cut with the cutter 40 as in the section (e) of FIG. 4 after the section (d) of FIG. 4, the user needs to cut with an appropriate cutting tool. However, when the boundary part 203 exists at the position facing the cutter 40 illustrated in the section (a) of FIG. 5, a part of the first tape portion 103*a* on which the print R of "ABCD" is formed on the downstream side of the boundary portion 203 remains in the section of a distance Lb between the cutter 40 and the discharge port 3*a*. That is, in this example, although the entirety of character "A" and the downstream half of the character "B" of "ABCD" is exposed from the discharge port 3*a* to the outside of the casing 3A, the upstream half of the character "B" and the character "CD" remain inside the casing 3A. For that reason, when the user cuts the first tape portion 103*a* with a cutting tool outside the casing 3A while keeping the state illustrated in the sections (a) of FIG. 5, as illustrated in sections (b) and (c) of FIG. 5, in this example, it is only possible to divide the middle of the character "B", that is, in the middle of the print label L.

In order to avoid such division described above, it is also conceivable to remove the cartridge 7 from the cartridge holder 6 in the state illustrated in the section (a) of FIG. 5 and cut the boundary part 203 in the removed state, but in that case, the work of removing the cartridge 7 becomes complicated for the user.

Method of Illustrative Embodiment

Therefore, in the label printer 3 of the present illustrative embodiment, in order to avoid the complication described above, in addition to the tape transportation for the distance La described above, tape transportation for the distance Lb between the cutter 40 and the discharge port 3*a* is additionally performed. That is, in the present illustrative embodiment, the boundary part 203 as illustrated in the sections (a), (b), (c) of FIG. 4 and in section (a) of FIG. 6 that is similar to the section (d) of FIG. 4 is used. The tape is further transported after the state of facing the cutter 40 (see the white block arrow). Then, after going through the states illustrated in sections (b) and (c) of FIG. 6, as illustrated in section (d) of FIG. 6, when the boundary part 203 reaches a facing part facing the edge of the discharge port 3*a* in the wall surface direction of the casing 3A, the transportation is stopped and the positioning is performed. As described above, it is not limited to the fact that the transportation is stopped and the positioning is performed when the boundary part 203 reaches the facing part, and the transportation may be stopped and the positioning may be performed when the boundary part 203 is discharged to the outside of the casing 3A. In the description as above, the tape transportation for the distance La+Lb may be performed at once, or the tape transportation for the distance La may be performed and the transportation is temporarily stopped, and then the tape transportation for the distance Lb may be performed again. With this configuration, as illustrated in the section (e) of FIG. 6, the user can obtain the print label L by cutting the boundary part 203 with the cutting tool outside the casing 3A.

Figure 6:
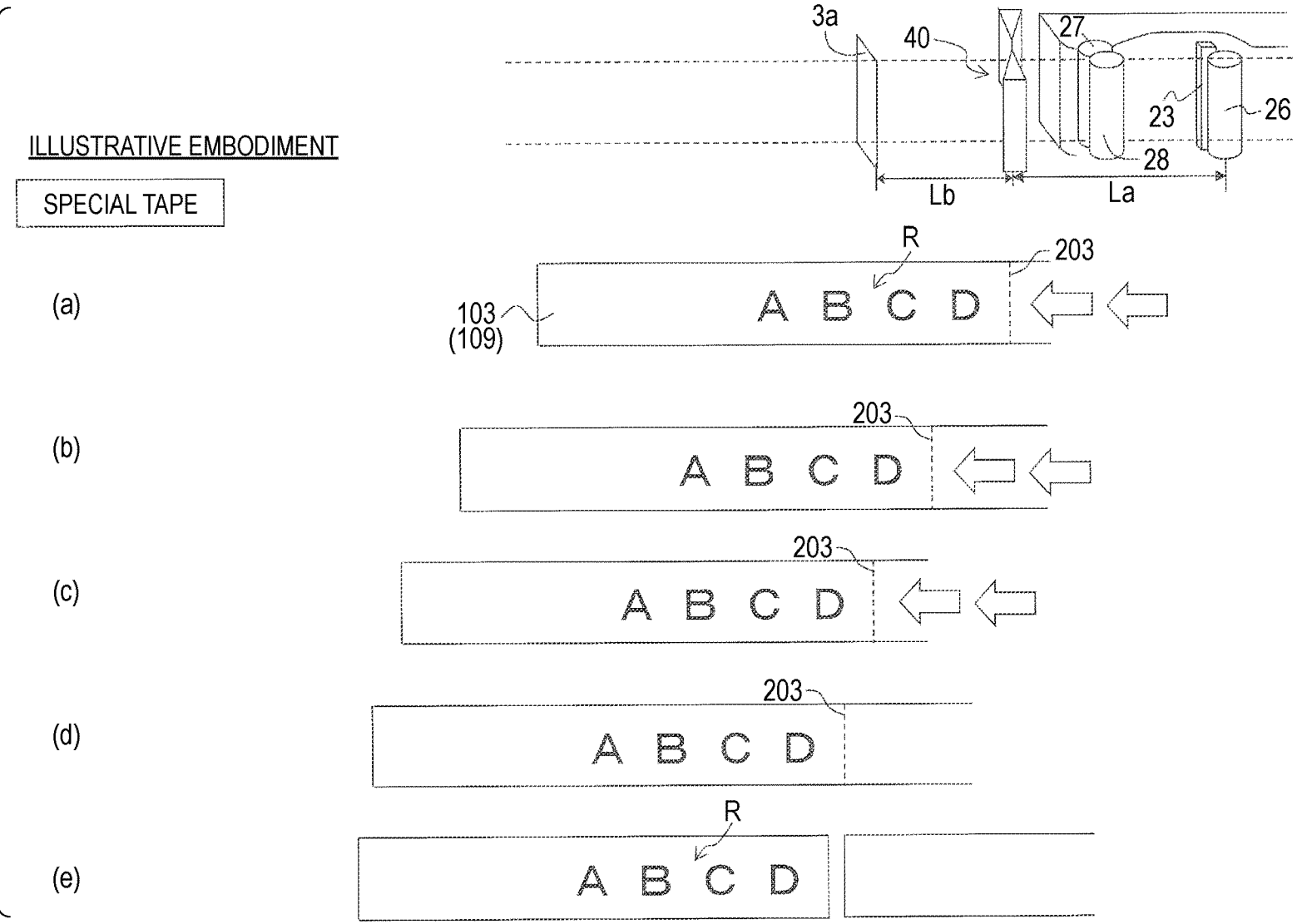
FIG. 6 is an explanatory diagram illustrating an example of a process of creating a print label when the special tape is used in the illustrative embodiment of the present disclosure.
Figure 7:
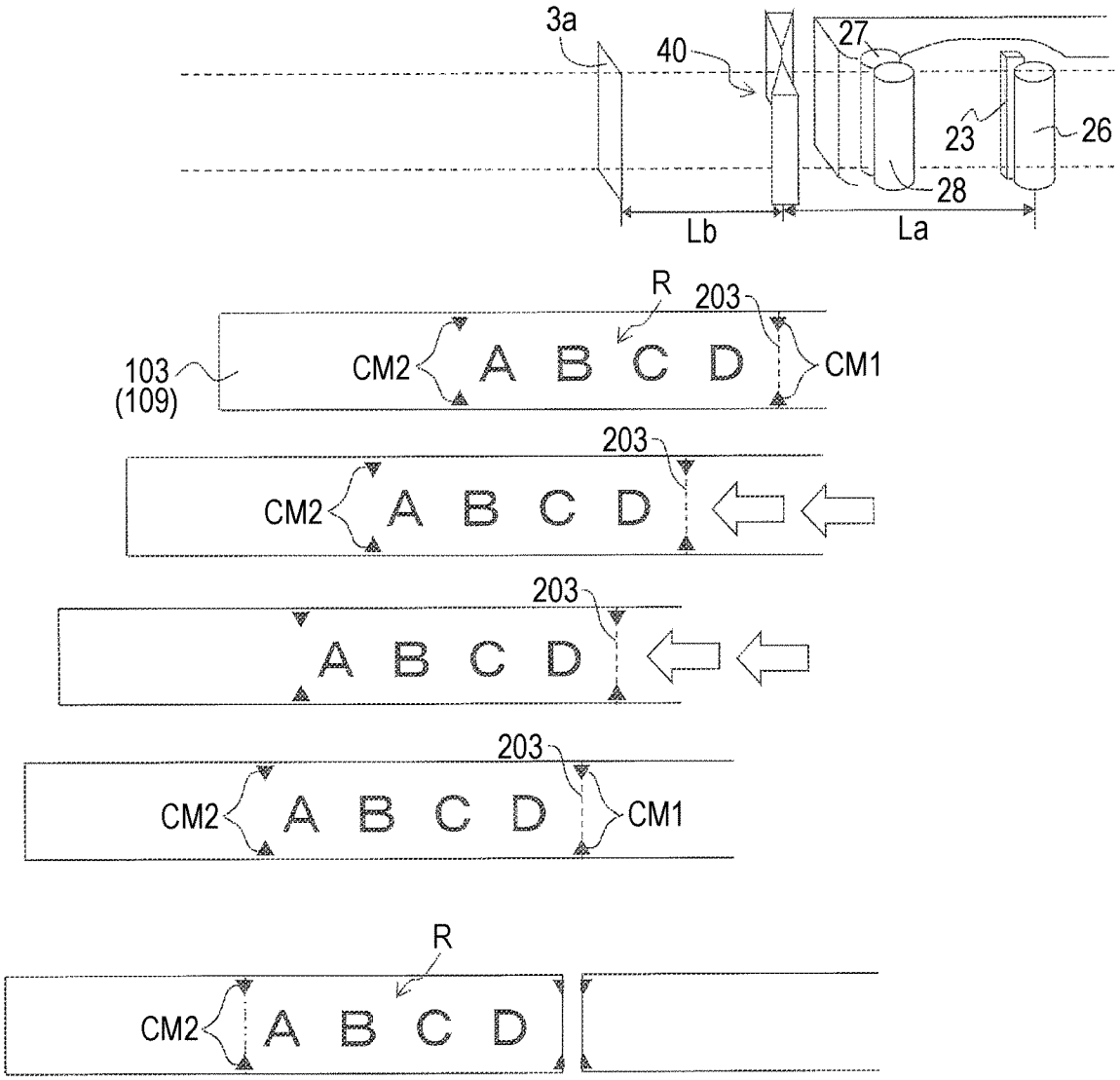
FIG. 7 is an explanatory diagram illustrating another example of the process of creating the print label when the special tape is used in the illustrative embodiment of the present disclosure.

In the method described above, as illustrated in sections (a) to (e) of FIG. 7 corresponding to the sections (a) to (e) of FIG. 6, respectively, after forming the print R on the first tape portion 103*a*, a cut mark CM1 serving as a mark at the time of cutting with the cutting tool may be printed on the boundary part 203. In this example, the cut mark CM1 has two triangular shapes facing each other. The cut mark CM1 corresponds to an example of a first cut mark. As illustrated in the sections (a) to (e) of FIG. 7, before the formation of the print R on the first tape portion 103*a*, a cut mark CM2 may be printed on the end portion of the first tape portion 103*a* on the downstream side in the transport direction. In this example, the cut mark CM2 has two triangular shapes that face each other like the cut mark CM1, but may have a different shape from the cut mark CM1. The end portion on the downstream side in the transport direction corresponds to an example of a second boundary part, and the cut mark CM2 corresponds to an example of a second cutting mark. In this case, the user can obtain the print label L with a small margin by cutting the portion of the cut mark CM2 with the cutting tool (see the chain double-dashed line in FIG. 7).

<Control Contents Executed by CPU>

A control procedure executed by the CPU 111 of the label printer 3 in order to implement the method of the present illustrative embodiment will be described with reference to the flowchart of FIG. 8. Before the flow is executed, the label print content of the print label L is input and set in advance by an operator using the touch panel 17 of the operation terminal 2. Then, when the communication with the operation terminal 2 is established via the communication controller 208 and the communication controller 15 and a printing start command including the label print is received from the operation terminal 2, this flow is started.

First, in step S5, the CPU 111 obtains medium information of the printing tape 103 provided in the cartridge 7 mounted in the cartridge holder 6. The medium information is information indicating whether the printing tape 103 is a normal tape which is set as a cutting target by the cutter 40 or a special tape which is not set as the cutting target by the cutter 40. In step S5, the medium information input by the user by operating the touch panel 17 or the operation buttons 14 of the operation terminal 2 is obtained through communication between the communication controllers 15 and 208. Alternatively, by detecting the type of the cartridge 7 by a known sensor provided in the cartridge holder 6, for example, the medium information corresponding to the detection result of the sensor may be obtained in step S5. The process executed in step S5 corresponds to an example of the medium information obtain process, and the sensor corresponds to an example of a detection unit.

After that, in step S10, the CPU 111 determines whether the printing tape 103 in the cartridge 7 is the special tape, based on the medium information obtained in step S5. When it is determined that the printing tape 103 is a special tape, it is determined as YES in step S10, and the process proceeds to step S15, which will be described later, and when it is determined that the printing tape 103 is a normal tape, it is determined as NO in step S10, and the process proceeds to step S55.

In step S15, the CPU 111 starts the tape transportation. Specifically, the tape feed roller drive shaft 108 is rotated via the transport motor 119 to start the transportation of the printing tape 103, the base tape 101, and the printed label tape 109.

Then, in step S20, the CPU 111 determines whether each of the tapes started to be transported as described reaches a print start position of the printing tape 103. Specifically, in this example, it is determined, by a known method, whether the leading end portion of the print area on the downstream side described above faces the position facing the print head 23. When it is determined that the print start position is not reached, it is determined as NO, and the tape transportation is continued until the print start position is reached. When it is determined that the print start position is reached, it is determined as YES, and the process proceeds to step S25.

In step S25, the CPU 111 controls the print head 23 while performing the tape transportation, and forms the cut mark CM2 having a predetermined shape, which is a triangular shape in the example described above, on the printing tape 103. The cut mark CM2 may not be formed. The process executed in step S25 corresponds to an example of a second mark print process.

After that, in step S30, the CPU 111 controls the print head 23 while further performing the tape transport, and forms the label print included in the printing start command described above transmitted from the operation terminal 2 on the printing tape 103. The label print is the print R of "ABCD" in the example described above. The process executed in step S30 corresponds to an example of the print forming process when the printing medium is not set as the cutting target.

After that, in step S35, the CPU 111 controls the print head 23 while performing the tape transportation similarly as in step S25, and forms the cut mark CM1 having a predetermined shape, which is a triangular shape in the example described above, on the printing tape 103. The cut mark CM1 may not be formed. The process executed in step S35 corresponds to an example of a first mark print process.

After that, in step S40, the CPU 111 determines whether the boundary part 203, which is the upstream side end portion of the first tape portion 103*a*, of the printing tape 103 is in a state of facing the cutter 40, while further performing the tape transportation after the process in step S35. When it is determined that the boundary part 203 is not in a state of facing the cutter 40, it is determined as NO, and the process waits in a loop. On the other hand, when it is determined that the boundary part 203 is in a state of facing the cutter 40, it is determined as YES, and the process proceeds to step S45.

In step S45, the CPU 111 further transports the tape by the distance Lb, and then in step S48, stops the rotation of the tape feed roller drive shaft 108 by the transport motor 119 to stop the tape transportation. The value of the distance Lb is previously stored in the EEPROM 118 as a value unique to the label printer 3, and the value of Lb is read out and used in step S45.

At this time, it is sufficient to detect that a transportation amount during the tape transportation reaches the distance Lb by a known method such as counting the number of pulses to the transport motor 119 which is, for example, a pulse motor. The process executed in steps S45 and S48 corresponds to an example of the first transport process.

After that, in step S50, the CPU 111 outputs a display signal to the operation terminal 2 via the communication controllers 208 and 15 and notifies the touch panel 17 of prompting the cutting of the boundary part 203. In this example, as illustrated in FIG. 1 described above, on the touch panel 17, a visual notification is given by a message M of "You are ready to cut. Please cut with scissors and the like". The process executed in step S50 corresponds to an example of a display signal output process. At this time, the label printer 3 may be provided with an appropriate display unit, and the visual notification similar to the message M may be performed on the display unit in step S50. In this case, the process executed in step S50 corresponds to an example of a display process. Then, this flow ends.

On the other hand, in step S55 after it was determined as NO in step S10 described above, the CPU 111 starts the tape transportation as described above in step S55 which is similar to step S15. After that, the CPU 111 determines whether the print start position of the printing tape 103 is reached in step S60 which is similar to step S20. When the print start position is not reached, it is determined as NO and the process waits in a loop. On the other hand, when the print start position is reached, it is determined as YES, and the process proceeds to step S70.

In step S70, similarly to step S30, the CPU 111 controls the print head 23 to form the label print included in the printing start command transmitted from the operation terminal 2 on the printing tape 103. The process executed in step S70 corresponds to an example of the print forming process when the printing medium is set as the cutting target.

After that, in step S80 similar to step S40, the CPU 111 further determines whether the boundary part 203 is in the state of facing the cutter 40 while further performing the tape transport. When it is determined that the boundary part 203 is not in a state of facing the cutter 40, it is determined as NO, and the process waits in a loop. On the other hand, when it is determined that the boundary part 203 is in a state of facing the cutter 40, it is determined as YES, and the process proceeds to step S90.

In step S90, the CPU 111 stops the tape transportation, similarly as in step S48. After the execution of step S70, the transportation of the transportation amount performed until the determination result of step S80 becomes YES corresponds to an example of a second transport process.

After that, in step S95, the CPU 111 controls the cutter motor 43 to drive the cutter 40 to cut the boundary part 203. With this configuration, the first tape portion 103*a* is separated from the second tape portion 103*b*, and the print label L is produced by the separated first tape portion 103*a*. The process executed in step S95 corresponds to an example of a cutting process.

After that, in step S98, the produced print label L is discharged to the outside of the casing 3A, and this flow ends.

Advantages of Illustrative Embodiment

As described above, in the label printer 3 of the present illustrative embodiment, the print R is formed on the first tape portion 103*a* of the printing tape 103 being transported. In a case where the normal tape is used, the print label L is created by the cutter 40 cutting the boundary portion 203 when the printing tape 103 after the print R is formed is further transported, and the boundary part 203, which is the upstream side end portion of the first tape portion 103*a*, reaches the position facing the cutter 40 on the downstream side of the print head 23.

In this case, in the present illustrative embodiment, in order to avoid the complication for the user when the special tape other than the normal tape is used, by the CPU 111, first, step S5 is executed and the medium information of the printing tape 103 mounted on the label printer 3 at that point in time is obtained. This medium information is information corresponding to the type of the printing tape 103, which indicates whether the printing tape 103 is a normal tape which is set as the cutting target by the cutter 40 or a special tape which is not set as the cutting target by the cutter 40.

When the printing tape 103 is the special tape, steps S15 to S50 are executed by the CPU 111. In step S30, the desired print R is formed on the first tape portion 103*a* while the printing tape is being transported. After that, the transportation is stopped and the positioning is performed at the timing when the printing tape 103 is transported and the boundary portion 203, which is the upstream side end portion of the first tape portion 103*a* on which the print R is formed, is discharged from the discharge port 3*a* of the casing 3A to the outside of the casing, or when the printing tape 103 is transported and the boundary part 203 faces the edge of the discharge port 3*a*. With this configuration, the user cuts the boundary part 203 exposed outside the casing 3A or at the position of the discharge port 3*a* of the casing 3A with a cutting tool as it is, thereby capable of obtaining the print label L on which desired print is formed. With this configuration, the complication of the user who needs to remove the cartridge as described above can be eliminated, and the convenience for the user can be improved.

At this time, particularly in the present illustrative embodiment, when there is a normal tape that is not a special tape for the printing tape 103, steps S55 to S98 are performed. With this configuration, as usual, the boundary part 203 can be cut with the cutter 40 after forming the desired print on the first tape portion 103*a*.

Particularly in the present illustrative embodiment, in step S45, the tape 109 for the printed label is transported along the transport path by the distance Lb corresponding to the distance between the cutter 40 and the discharge port 3*a*. In this way, by transporting the tape by a distance corresponding to the distance between the cutter 40 and the discharge port 3*a*, the user can surely transport and expose the boundary part 203 to be manually cut to the outside of the discharge port 3*a* or the casing 3A.

Particularly in the present illustrative embodiment, the distance Lb is stored in the EEPROM 118. With this configuration, the value of the distance Lb can be reliably held even when the power of the label printer 3 is turned off, and the boundary part 203 can be surely exposed at each use by the user.

Particularly in the present illustrative embodiment, in step S5, the medium information is obtained from the operation terminal 2 connected to the label printer 3 in a wire or wireless manner. With this configuration, it is possible to notify the label printer 3 side that the printing tape 103 to be used is of a type that is difficult to cut or that it is better not to cut, in a form that reflects the user's intention, and to prevent cutting with the cutter 40.

Alternatively, as described above, the type of the printing tape 103 can be detected by the sensor provided in the label printer 3. In this case, when the printing tape 103 is a special tape, it can be automatically detected by the label printer 3 side without the need for the user to manually input the type of the tape, and the cutting by the cutter 40 can be prevented.

Particular in the present illustrative embodiment, in step S50, a display signal for performing display prompting the cutting of the boundary part 203 by a manual operation is output to the operation terminal 2, and the corresponding message M is displayed on the operation terminal 2, after stopping of the tape transportation and the positioning in step S48 is finished. Alternatively, as described above, similar display can be performed on the display unit provided in the label printer 3. With this configuration, it is possible to surely make the user recognize that the transportation is finished without cutting by the cutter 40 and a cutting waiting state by the user's manual operation is entered. In particular, when the cutting is not automatically performed by the cutter 40 on the label printer 3 side by the detection through the sensor described above, the effect described above is particularly effective, because the cutting waiting state is entered without the user's knowledge.

Particularly in the present illustrative embodiment, after the desired print R is formed on the first tape portion 103*a* in step S30, the cut mark CM1 is formed on the boundary part 203. With this configuration, the user can easily cut the boundary part 203 on the tape 109 for the printed label, which is in the cutting waiting state in step S48, while using the formed cut mark CM1 as a guide.

Particularly in the present illustrative embodiment, before the desired print R is formed on the first tape portion 103*a* in step S30, the cut mark CM2 is printed on the boundary part positioned at the end portion of the first tape portion 103*a* on the downstream side in the transport direction. With this configuration, the user can easily cut the boundary part while using the formed cut mark CM2 as a guide.

The present disclosure is not limited to the illustrative embodiment described above, and various modifications can be made without departing from the spirit and technical idea thereof. Hereinafter, such modified examples will be described in order. The same portions as those in the illustrative embodiment described above are designated by the same reference numerals, and the description thereof will be omitted or simplified as appropriate.

(1) When Transportation Distance for Sending Out a Boundary Part is Variable:

That is, in the illustrative embodiment described above, the distance for sending out the boundary part 203 to the discharge port 3*a* of the casing 3A in step S45 is fixedly set to a value equal to the distance Lb between the cutter 40 and the discharge port 3*a*. In contrast, in this modified example, the distance for this sending out is variably set according to the type of the special tape. That is, when the printing tape 103, which is a special tape, is a cloth, for example, it is easier for the user to apply tension and pull the cloth tight when cutting the cloth with a cutting tool. In this case, it is convenient to lengthen the predetermined distance for sending out the boundary part 203 so that the cloth can be easily gripped by hand. On the contrary, in the printing tape 103 of the type that can be cut without applying such tension, it is possible to suppress waste of the printing tape 103 and the like by making the predetermined distance as short as possible.

Therefore, in the present modified example, the predetermined distance described above is variably set according to each type of the printing tape 103 in response to the situation described above. In this case, for example, a correlation between the types of the plurality of printing tapes 103 prepared in advance and the predetermined distances corresponding to the types may be stored in an appropriate part, for example, the memory 117 or the EEPROM 118. Then, for example, as described above, the predetermined distance is variably set by referring to the correlation based on the medium information input by the user by operating the operation terminal 2, or the medium information obtained corresponding to the detection result of the sensor. With this configuration, the convenience for the user can be further improved.

(2) When Two Control Modes are Provided:

That is, in this modified example, as described above, the label printer 3 has two control modes of a first mode in which cutting with the cutter 40 is not performed only when the printing tape 103 is a special tape and a second mode in which cutting with the cutter 40 is performed regardless of whether the printing tape 103 is a special tape or a normal tape. That is, when the first mode is selected, each procedure illustrated in FIG. 8 is executed by the CPU 111. On the other hand, when the second mode is selected, steps S5 to S50 in FIG. 8 are omitted, and only steps S55 to S98 are executed. In this case, the first mode or the second mode may be selectable by the user via the operation of the operation terminal 2, or the label printer 3 may be fixedly set in advance in either the first mode or the second mode. The setting may be stored in the EEPROM 118. The first mode corresponds to an example of a first control mode, and the second mode corresponds to an example of a second control mode.

In this modified example, it is possible to appropriately select whether to use the function of preventing the cutter 40 from cutting the printing tape 103, that is a special tape that is difficult to cut or a special tape that is not to be cut, depending on the preference and needs of the user.

(3) When Creating a Print Label by Continuous Printing:

In the illustrative embodiment described above and the modified examples described in (1) and (2), the print label L was produced by cutting the boundary portion 203 which is the upstream side end portion of the first tape portion 103*a* and separating the boundary portion 203 from the second tape portion 103*b* positioned on the upstream side thereof. In the present modified example, a plurality of print labels L (hereinafter, simply referred to as "print label portion Lo") are continuously connected to each other, and only the print label portion Lo produced last among the plurality of print label portions Lo is cut by the boundary part 203 as described above and is separated from the second tape portion 103*b* positioned on the upstream side thereof. Hereinafter, the method of creating a print label by such a method is referred to as "continuous printing" as appropriate.

Next, a process of creating the print label L in the present modified example by the continuous printing will be described.

<Print Label Creation Using Normal Tape>

First, a case where a normal tape is used as the printing tape 103 will be described with reference to sections (a) to (g) of FIG. 9. In this example, a case where three print labels L are produced by continuous printing will be described as an example. First, similar to the example described with reference to the sections (a) to (c) of FIG. 4 described above, when the printing start command is input, the tape transportation is started, and the print formation of "ABCD" is started on the first tape portion 103*a* of the printing tape 103. When print of all the characters "ABCD" is completed as described above, energization to the print head 23 is finished, and the boundary part 203 is slightly further transported until the boundary part 203 faces the print head 23, and then the tape transportation is stopped and positioning is performed. The section (a) of FIG. 9 illustrates the positioning stopped state corresponding to the section (c) of FIG. 4.

At this time, unlike the described above FIG. 4, the cutting by the cutter 40 is not performed, and the first tape portion 103*a* on which the print R of "ABCD" is formed remains connected to a succeeding tape 109 for the printed label via the boundary part 203. In this modified example, the first tape portion 103*a* after such a print R is formed is referred to as a print label portion Lo as appropriate, which is equivalent to the print label L. With this configuration, production of one of the three print label portions Lo is completed.

Figure 9:
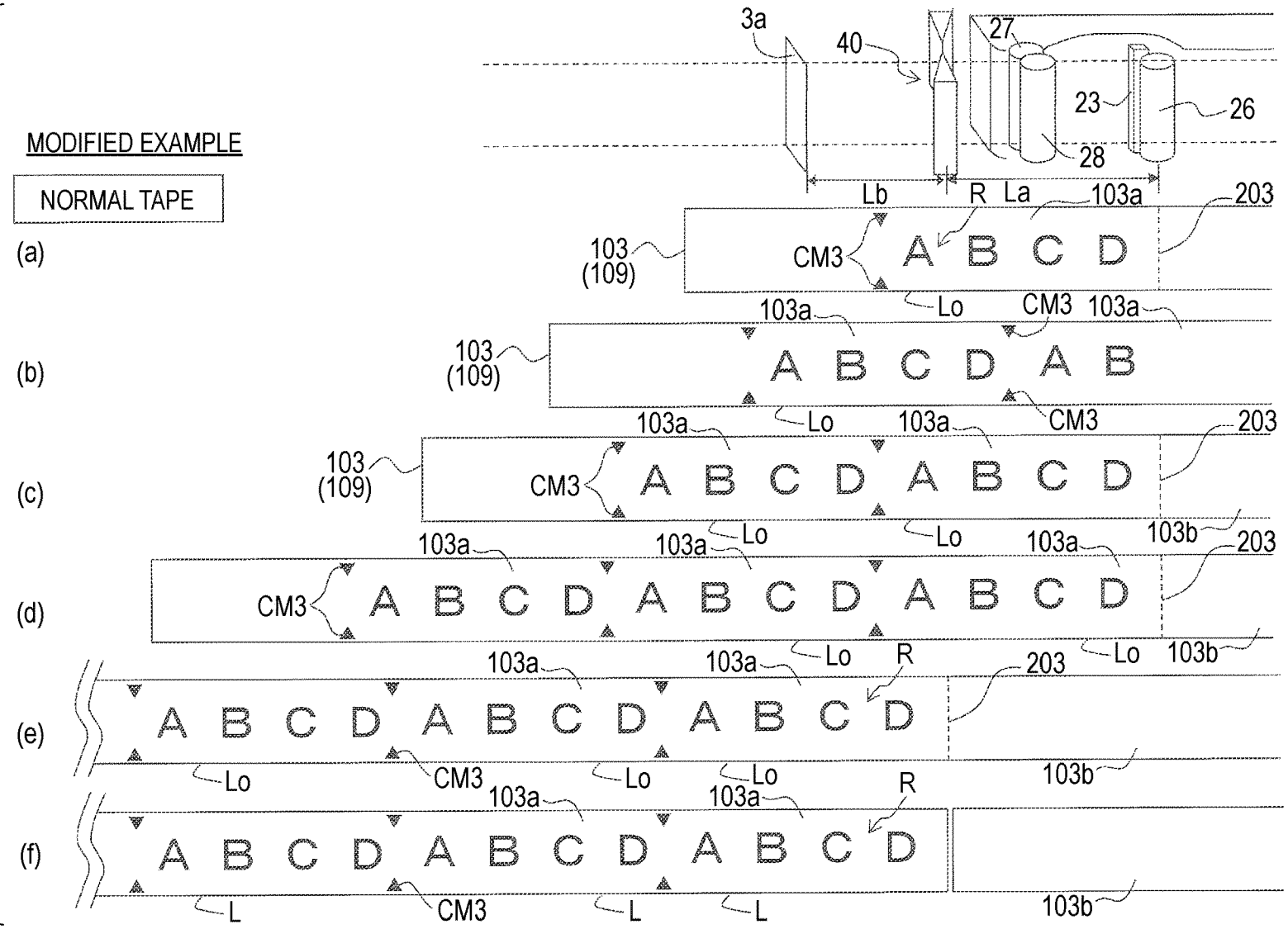
FIG. 9 is an explanatory diagram illustrating an example of a process of creating a print label when a normal tape is used in a modified example in which continuous printing is performed.

After that, the tape transportation is restarted, and the print formation of "ABCD" is started again on the similar first tape portion 103*a* subsequent to the first tape portion 103*a* described above of the printing tape 103 (see the section (b) of FIG. 9). In the present modified example, the boundary part 203 between the adjacent print label portions Lo and Lo is not cut, and correspondingly, when the print formation is restarted, the cut mark CM3 is print-formed on the boundary portion 203. In this example, the cut mark CM3 has two triangular shapes facing each other, like the cut marks CM1 and CM2 described above. In the example illustrated in FIG. 9, the cut mark CM3 is also formed at the leading end on the downstream side of the foremost first tape portion 103*a* in the transport direction, that is, the part where the print area starts. Then, similarly to the matters described above, when print of the characters "ABCD" is completed, energization to the print head 23 is finished. The section (c) of FIG. 9 illustrates a state in which the transportation further progresses after energization is finished, and the vicinity of the boundary part 203 faces the print head 23. With this configuration, production of two of the three print label portions Lo is completed.

After that, the same process as described above is further repeated, and when print of the characters of "ABCD" is completed, energization to the print head 23 is finished. The section (d) of FIG. 9 illustrates a state in which the transportation further progresses after energization is finished, and the vicinity of the boundary part 203 which is the upstream side end portion of the third print label portion Lo faces the print head 23, and as a result, the production of the three print label portions Lo are all completed.

After that, also in this modified example, as described above with reference to the section (d) of FIG. 4, only the tape transportation is continuously performed as illustrated in the section (e) of FIG. 9. The transportation is continued until the boundary part 203 faces the cutter 40, and when the boundary part 203 faces the cutter 40, the tape transportation is stopped and the positioning is performed (see the section (e) of FIG. 9). Similar to the matters described above, the transportation distance of the tape transported from the state illustrated in the section (d) of FIG. 9 to the state illustrated in the section (e) of FIG. 9 is equal to the distance La from the print head 23 to the cutter 40.

After that, the cutter 40 is driven to cut the boundary part 203 (see the section (f) of FIG. 9). With this configuration, from the second tape portion 103*b* on the upstream side of the boundary part 203 of the printing tape 103, the three print label portions Lo on which the prints "ABCD" are respectively formed and which are continuous with each other are separated, and the three print labels L are produced. These three print labels L are discharged from the discharge port 3*a* similarly as in the section (f) of FIG. 4 described above.

<Print Label Creation Using Special Tape>

Figure 10:
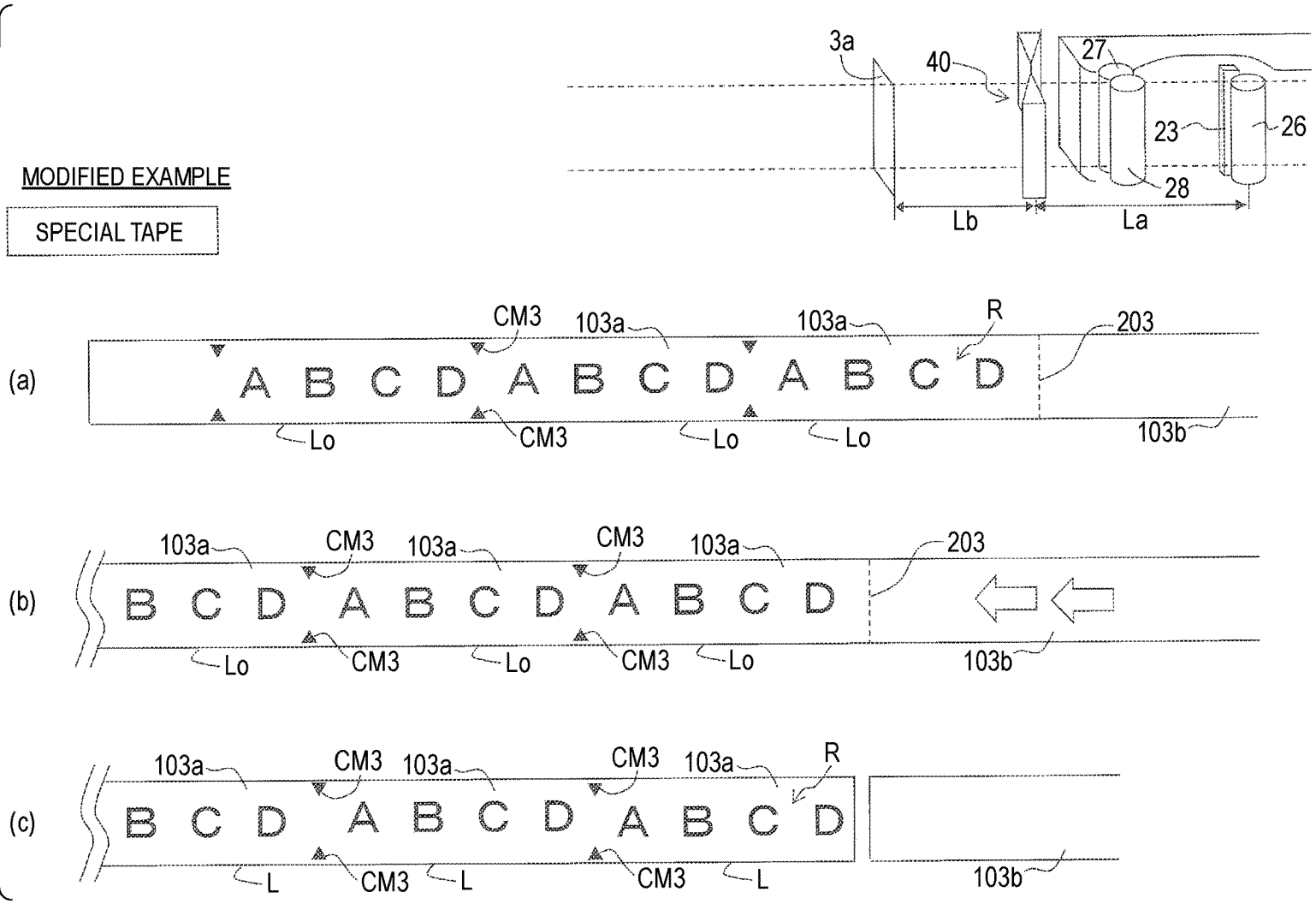
FIG. 10 is an explanatory diagram illustrating an example of a process of creating a print label when a special tape is used in the modified example in which continuous printing is performed.

Next, a case where a special tape is used as the printing tape 103 will be described with reference to sections (a) to (c) of FIG. 10. In this example, a case where three print labels L are produced by continuous printing will be described as an example.

In this case, in the same manner as described above with reference to FIG. 6 in the illustrative embodiment described above, in order to avoid complication by the user, in addition to the tape transportation for the distance La described above, the tape transportation for the distance Lb is additionally performed. That is, in this modified example, after the boundary part 203 comes into a state of facing the cutter 40 as illustrated in the sections (a), (b), (c), (d) of FIG. 9 and in the section (a) of FIG. 10 that is similar to the section (e) of FIG. 9, the tape transportation is further executed (see the white block arrow in the section (b) of FIG. 10). Then, as illustrated in the section (b) of FIG. 10, when the boundary part 203 reaches a facing part facing the edge of the discharge port 3*a* in the wall surface direction of the casing 3A, the transportation is stopped and the positioning is performed. Similarly to the matters described above, when the boundary part 203 is discharged to the outside of the casing 3A, the transportation may be stopped and the positioning may be performed. The tape transportation for the distance La+Lb may be performed at once, or the tape transportation for the distance La may be performed and the transportation is temporarily stopped, and then the tape transportation for the distance Lb may be performed again. With this configuration, as illustrated in the section (c) of FIG. 10, the user can obtain three print labels L that are continuous with each other by cutting the boundary part 203 with the cutting tool outside the casing 3A. When the third print label portion Lo is produced, similar to the matters described above, after forming the print R of "ABCD" on the first tape portion 103*a*, a cut mark serving as a mark at the time of cutting with the cutting tool described above may be printed on the boundary part 203 (not illustrated).

<Control Contents Executed by CPU>

Figure 11:
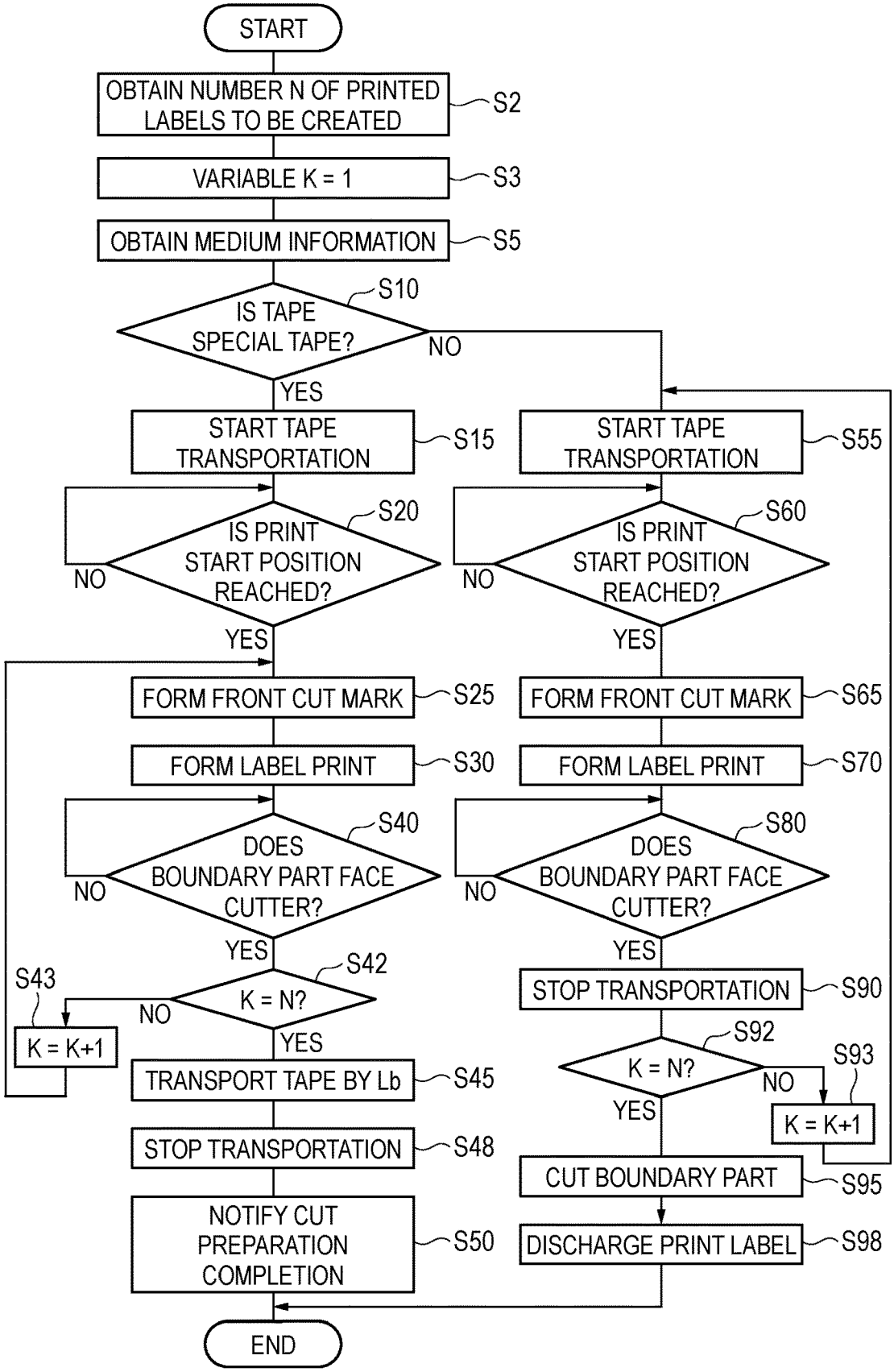
FIG. 11 is a flowchart illustrating a control procedure executed by the CPU.

A control procedure executed by the CPU 111 of the label printer 3 in order to implement the method of this modified example will be described with reference to the flowchart of FIG. 11 corresponding to FIG. 8 described above. Before the flow is executed, the number N of print labels L to be created and the content of each label print is input and set in advance by the operator using the touch panel 17 of the operation terminal 2. Then, when the communication with the operation terminal 2 is established via the communication controller 208 and the communication controller 15 and a printing start command including the number N of print labels L to be created and the label print are received from the operation terminal 2, this flow is started.

First, in step S2, the CPU 111 obtains the number N of print labels L to be created, which is included in the printing start command transmitted from the operation terminal 2. In the example described above, N=3.

After that, in step S3, the CPU 111 initializes a counter variable K, which corresponds to the number of times of print processing on the printing tape 103, in other words, the number of created print label portions Lo, to 1.

Figure 8:
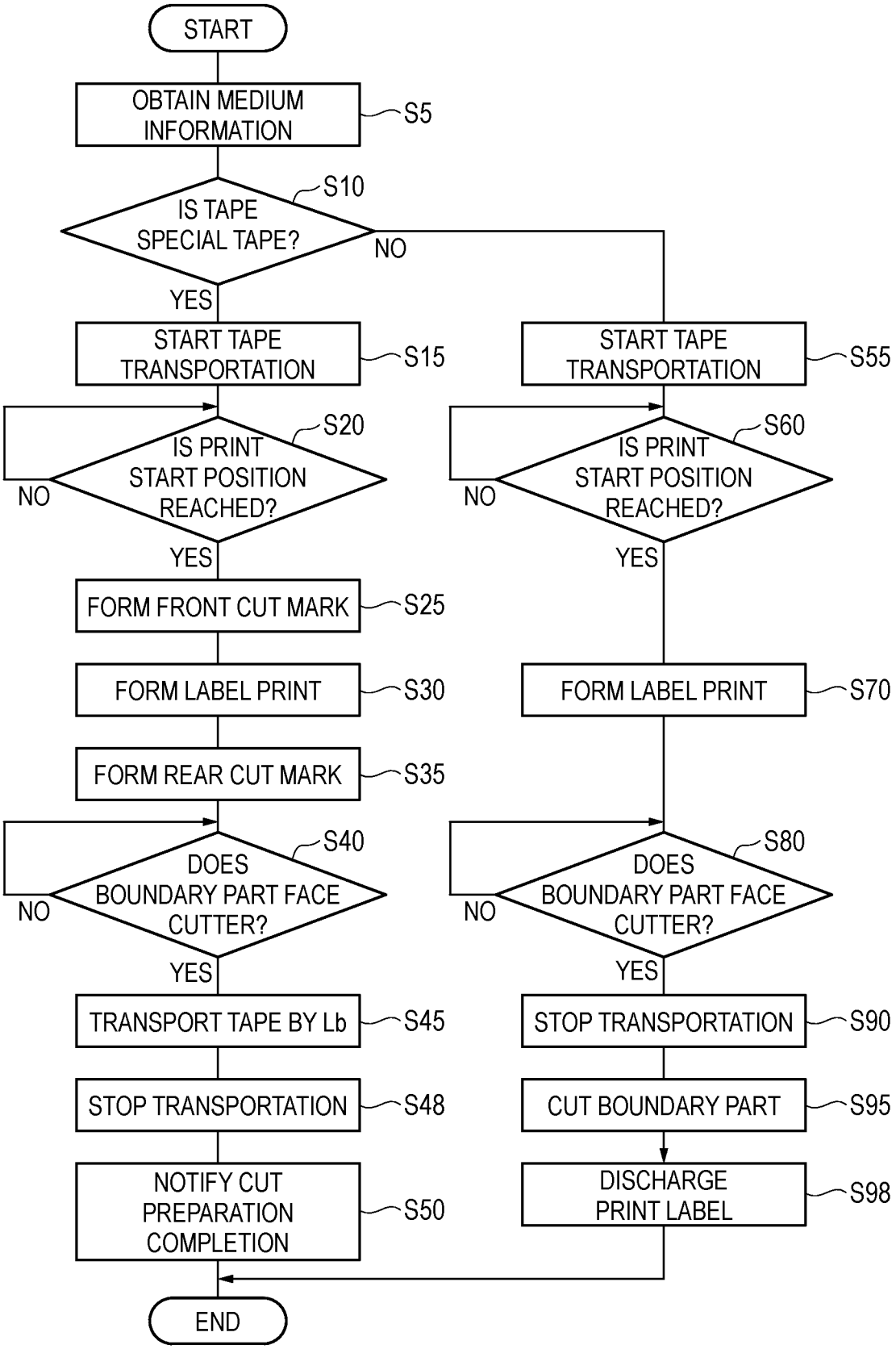
FIG. 8 is a flowchart illustrating a control procedure executed by a CPU.

The subsequent steps S5 and S10 are the same as those in FIG. 8. When it is determined as YES in step S10, after going through steps S15, S20, and S25 similar to those in FIG. 8, in step S30, the CPU 111 forms, on the printing tape 103, the print content corresponding to the value of the counter variable K at that point in time of the label print included in the printing start command described above. The label print is the print R of "ABCD" in the example described above. Also in this modified example, the process executed in step S30 corresponds to an example of the print forming process when the printing medium is not set as the cutting target. After that, in this modified example, step S35 in FIG. 8 is omitted and the process proceeds to step S40.

In step S42 newly provided after going through step S40 similar to FIG. 8, the CPU 111 determines whether the value of the counter variable K at that point in time reaches the number N of print labels L to be created obtained in step S2. If K<N, it is determined as NO, K is incremented by 1 in step S43, and then the process proceeds to step S25 and the same procedure is repeated. If K=N in step S42, it is determined as YES, and steps S45, S48, and S50 similar to those in FIG. 8 are executed, and this flow ends. In this case, also in this modified example, the process executed in steps S45 and S48 corresponds to an example of the first transport process, and the process executed in step S50 corresponds to an example of the display signal output process.

On the other hand, if it is determined as NO in step S10 described above, after going through steps S55 and S60 similar to FIG. 8, and if it is determined as YES in step S60, the process proceeds to newly provided step S65.

In step S65, similarly to step S25 described above, the CPU 111 controls the print head 23 while performing the tape transportation, and forms a cut mark CM3 having a predetermined shape, which is a triangular shape in the example described above, on the printing tape 103. After that, after going through steps S70, S80, and S90 similar to those in FIG. 8, the process proceeds to newly provided step S92. Also in this modified example, the transportation of a transportation amount, which is executed until the determination result of step S80 becomes YES after the execution of step S70, corresponds to an example of the second transport process.

In step S92, similarly to step S42 described above, the CPU 111 determines whether the value of the counter variable K at that point in time reaches the number N of print labels L to be created obtained in step S2. If K<N, it is determined as NO, K is incremented by 1 in step S93, and then the process proceeds to step S55, and the same procedure is repeated. If K=N in step S92, it is determined as YES, steps S95 and S98 similar to those in FIG. 8 are executed, and this flow ends. Also in this modified example, the process executed in step S95 corresponds to an example of the cutting process.

Advantages of this Modified Example

As described above, in this modified example, when N (N is an integer of 2 or more) print labels L are created, if the printing tape 103 is a special tape, the first to N−1th print labels L are created by repeating steps S25 to S40 N−1 times. After that, the Nth print label L is created by transporting the tape by the distance Lb in steps S25 to S40 and steps S45 to S48. In the example described above, N=3.

In this way, in this modified example, when so-called continuous printing in which a plurality of print labels L are continuously created is performed, the method of the illustrative embodiment described above is applied when the print label L created last is produced. With this configuration, the tape transportation is stopped and the positioning is performed at the timing when the boundary part 203 is discharged from the discharge port 3*a* of the casing 3A to the outside of the casing 3A or when the boundary part 203 faces the edge of the discharge port 3*a*. As a result, similarly to the matters described above, the user can easily cut the boundary part 203 related to the last print label L, which is exposed outside the casing 3A or at the position of the discharge port 3*a* of the casing 3A, with a cutting tool, and can improve convenience.

(4) Others

In the description as above, the operation terminal 2 is connected to the label printer 3 via a wired or wireless communication line, and the print label L was created by receiving the printing start command including the number N of print labels L to be created described above and printing data representing printing contents from the operation terminal 2. However, the present disclosure is not limited thereto. That is, the method described above may be applied to a so-called stand-alone type label printer 3 that produces and uses the printing data representing the number N of print labels L to be created and the printing contents based on an operation input of an operator to an operation unit appropriately provided in the label printer 3.

In the description as above, a method of performing print on the printing tape 103 different from the base tape 101 and attaching the printing tape and the base tape together was adopted, but the present disclosure is not limited thereto, and may be applied to a method in which print is performed on a printing layer or an image-receiving layer provided on a base tape, that is, a type in which tapes are not attached to each other.

In the description as above, the arrows illustrated in FIG. 3 indicate an example of the signal flow, and does not limit the signal flow direction. The flow charts illustrated in FIGS. 8 and 11 are not intended to limit the present disclosure to the procedures illustrated in the flow described above, and a procedure may be added or deleted, or the order thereof may be changed without departing from the spirit and technical idea of the disclosure.

In the printing apparatus of the present disclosure, a print is formed by the print unit on a predetermined part (first medium portion) of the printing medium transported by the transport unit. Then, when the printing medium after formation of the print is further transported and the upstream side end portion (hereinafter, appropriately referred to as a print portion upstream end) of the first medium portion reaches a position facing the cutting unit on the downstream side of the print unit, the cutting unit cuts the print portion upstream end to create a printed matter.

In the present disclosure, in order to avoid the complication described above, the controller first executes the medium information obtain process, and obtains the medium information of the printing medium mounted on the printing apparatus at that point in time. This medium information is information corresponding to the type of printing medium, which indicates whether the printing medium is to be cut by the cutting unit.

Then, when the printing medium is of a type that is not to be cut, the controller executes the print forming process and the first transport process. That is, the print unit and the transport unit cooperate with each other to form a desired print on the first medium portion of the printing medium while transporting the printing medium. After that, at the timing when the printing medium is further transported and the first boundary part of the upstream side end portion of the first medium portion on which the print is formed is discharged (or when facing the edge of the discharge port) from the discharge port of the casing to the outside of the casing, the transportation is stopped and positioning is performed. With this configuration, the user can obtain the first medium portion on which the desired print is formed by cutting the first boundary part exposed to the outside of the casing (or at the discharge port position of the casing) as it is with the cutting tool. With this configuration, the user's complication of removing the cartridge and the like as described above can be eliminated, and thus the convenience for the user can be improved.

In addition to the matters described above, the methods according to the illustrative embodiment described above and each modified example may be appropriately combined and used.

In addition, although not illustrated one by one, the present invention may be embodied with various modifications within a range not departing from the scope thereof.

What is claimed is:

1. A printing apparatus configured to form a printed matter by a printing medium on which a print is formed, the printing apparatus comprising:

a casing having a discharge port;

a transporter provided inside the casing and configured to transport the printing medium;

a print device that is provided on a transport path inside the casing, the printing medium being transported along the transport path to the discharge port by the transporter and is discharged from the discharge port to an outside of the casing, the print device being configured to form the print on the printing medium;

a cutter that is provided inside the casing at a position downstream of the print device along the transport path, the cutter being configured to cut the printing medium in a thickness direction; and a controller provided inside the casing, the controller being configured to perform:

obtaining medium information corresponding to a type of the printing medium and indicating whether to set the printing medium as a cutting target by the cutter; and in a case the printing medium is not set as the cutting target by the medium information obtained, controlling the transporter and the print device in cooperation with each other to execute:

a print forming process comprising forming a desired print while transporting the printing medium; and a first transport process comprising:

further transporting the printing medium after completion of the print forming process; and performing positioning by stopping the transporting of the printing medium, in a case a first boundary part of the printing medium reaches a facing part facing an edge of the discharge port along a wall surface direction of the casing or in a case the first boundary part is discharged to the outside of the casing, the first boundary part being positioned at an end portion of a first medium portion on an upstream side in a transport direction on which the desired print is formed on the printing medium.

2. The printing apparatus according to claim 1, wherein in the first transport process, the transporter is configured to transport the printing medium by a predetermined distance corresponding to a distance between the cutter and the discharge port along the transport path.

3. The printing apparatus according to claim 2, further comprising:

a non-volatile memory, wherein in the first transport process, the transporter is configured to transport the printing medium by the predetermined distance having been stored in advance in the non-volatile memory.

4. The printing apparatus according to claim 2, wherein the predetermined distance is variably set according to each type of a plurality types of printing media which are not set as the cutting target by the medium information.

5. The printing apparatus according to claim 1, wherein in the obtaining of the media information, the controller is configured to obtain the medium information from an external device that is connected to the printing apparatus in a wired or wireless manner.

6. The printing apparatus according to claim 5, wherein the controller is further configured to, after the positioning by the first transport process is finished, perform outputting, to the external device, a display signal for displaying prompting cutting of the first boundary part by a manual operation.

7. The printing apparatus according to claim 5, further comprising:

a display, wherein the controller is further configured to, after the positioning by the first transport process is finished, control the display to display prompting cutting of the first boundary part by a manual operation.

8. The printing apparatus according to claim 1, further comprising:

a detector configured to detect the type of the printing medium, wherein in the obtaining of the media information, the controller is configured to obtain the medium information corresponding to a detection result of the detector.

9. The printing apparatus according to claim 1, wherein the controller is configured to, in a case the printing medium is set as the cutting target by the medium information obtained, control the transporter, the print device, and the cutter in cooperation with each other to execute:

the print forming process;

a second transport process comprising further transporting the printing medium after the completion of the print forming process and performing positioning by stopping the transporting of the printing medium in the case the first boundary part of the printing medium reaches the facing part; and a cutting process comprising cutting the first boundary part by the cutter to separate the first medium portion from a second medium portion, the second medium portion positioned at the upstream side of the cutting portion in the transport direction.

10. The printing apparatus according to claim 9, wherein the controller is selectably provided with:

a first control mode in which the print forming process and the first transport process are executed in the case the printing medium is not set as the cutting target by the medium information corresponding to the type of the printing medium; and a second control mode in which the print forming process, the second transport process, and the cutting process are executed regardless of the type of the printing medium.

11. The printing apparatus according to claim 1, wherein the controller is further configured to, in the case the printing medium is not set as the cutting target by the medium information obtained, control the transporter and the print device in cooperation with each other to print a predetermined first cutting mark on the first boundary part after forming the desired print on the first medium portion by the print forming process.

12. The printing apparatus according to claim 1, wherein the controller is further configured to, in the case the printing medium is not set as the cutting target by the medium information obtained, control the transporter and the print device in cooperation with each other to print a predetermined second cutting mark on a second boundary part before executing the print forming process, the second boundary part being positioned at an end portion of the first medium portion on the downstream side in the transport direction.

13. The printing apparatus according to claim 1, wherein the controller is configured to, in a case of creating N printed matters, where N is an integer of 2 or more, in the case the printing medium is not set as the cutting target by the medium information obtained, control the transporter and the print device in cooperation with each other and repeat the print forming process N−1 times to create a first to N−1th printed matters, and then control the transporter and the print device in cooperation with each other and perform the print forming process and the first transport process to create the Nth printed matter.

* * * * *